US005165349A

United States Patent [19]

McAllister

[11] Patent Number: 5,165,349

[45] Date of Patent: Nov. 24, 1992

[54] WORKTABLE WITH RECESSED LEG SUPPORTING GUSSETS

[75] Inventor: Larry N. McAllister, Dover, Del.

[73] Assignee: Metal Masters Foodservice Equipment Co., Smyrna, Del.

[21] Appl. No.: 742,360

[22] Filed: Aug. 8, 1991

[51] Int. Cl.[5] ..... A47B 3/06

[52] U.S. Cl. ..... 108/156; 248/188

[58] Field of Search ..... 108/156, 157, 159, 153; 248/188, 188.1, 188.8

[56] References Cited

U.S. PATENT DOCUMENTS

| | | | |
|---|---|---|---|
| 527,145 | 10/1894 | Dempsey | 248/188 |
| 3,267,888 | 8/1966 | Carlson | 248/188 |
| 3,309,051 | 2/1967 | Pina | 248/188 X |
| 3,406,935 | 10/1968 | Mutchnik et al. | 108/156 X |
| 3,530,804 | 9/1970 | Broome | 108/156 |
| 4,011,821 | 3/1977 | Neal | 108/156 |
| 4,925,140 | 5/1990 | Camarota | 248/188 |
| 5,026,010 | 6/1991 | Camarota | 248/188.1 |

FOREIGN PATENT DOCUMENTS

| | | | |
|---|---|---|---|
| 1460794 | 12/1966 | France | 108/156 |
| 2352516 | 12/1977 | France | 108/156 |
| 588470 | 5/1947 | United Kingdom | 108/157 |

*Primary Examiner*—Jose V. Chen

*Attorney, Agent, or Firm*—Connolly & Hutz

[57] ABSTRACT

A worktable has recessed leg gussets on the underside of the table top for supporting the legs of the table in a manner that eliminates pivot points where the legs are connected to the top. The underside of the table top has inverted hat-shaped channel frames secured thereto where the table legs are to be located. A leg gusset at each leg location extends through an opening in the inverted hat-shaped channel frame, and the gusset is upwardly recessed into the channel frame. The upper end of the gusset is secured to a plate connected between opposite sides of the channel frame while the middle section of the gusset is secured to the channel frame at the opening therein. The table legs are simply inserted into the gussets when the worktable is assembled.

2 Claims, 1 Drawing Sheet

WORKTABLE WITH RECESSED LEG SUPPORTING GUSSETS

BACKGROUND OF THE INVENTION

The present invention relates to a worktable, and more particularly to a table top having recessed leg supporting gussets on the underside thereof.

Prior to the present invention numerous arrangements have been proposed for securing support legs to a table top and the like. One of the primary considerations regarding these connections is that the legs adequately support the table top when loads are applied thereto. Also, these connections must resist lateral forces often applied to the table during use.

Gussets are commonly used to connect legs to a horizontally oriented table top. These gussets are often directly secured to the underside of the top and the legs are simply inserted into the socket portion of each gusset to complete the assembly. With the gussets secured in this manner potential pivot points exist where undesirable flexing may occur between the top and the leg gusset.

SUMMARY OF THE INVENTION

Accordingly, it is an object of the present invention to provide an improved connection between a table top and a plurality of leg supporting gussets on the underside thereof.

Another object of the present invention is an improved connection between a table top and a plurality of leg supporting gussets on the underside thereof which is simple in construction and which exhibits significant table stability during all uses thereof.

In accordance with the present invention, a worktable comprises a table top and table legs. Inverted hat-shaped channel frames are secured to the underside of the table top and openings are provided in the channel frames where the table legs are to be located. A leg supporting gusset is positioned at each leg location and the gussets extend through the openings in the channel frame to an upwardly recessed position. The gussets are fixedly secured to the channel frames and each gusset has a socket for receiving one of the table legs.

Preferably the channel frames include opposite side portions extending downwardly from the underside of the table top. Side flanges secured to the table top extend outwardly from these side portions, and a base portion spaced away from the table top and parallel thereto interconnects the opposite side portions. The openings for the leg gussets are located in the base portion of the channel frames.

Preferably a plate is secured between the opposite side portions of the channel frames. Moreover, each leg gusset includes an upper end secured to that plate and a middle section secured to the base portion of the channel frame at the opening therein.

BRIEF DESCRIPTION OF THE DRAWING

Novel features and advantages of the present invention in addition to those mentioned above will become apparent to persons of ordinary skill in the art from a reading of the following detailed description in conjunction with the accompanying drawing wherein similar reference characters refer to similar parts and in which:

FIG. 3 is a top plan view of the recessed leg supporting gusset shown in FIG. 3.

DETAILED DESCRIPTION OF THE INVENTION

Figure 1:
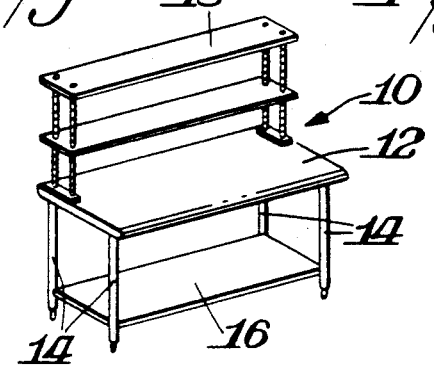
FIG. 1 is a perspective view of display shelving and a workable having recessed leg supporting gussets on the underside thereof, according to the present invention.
Figure 2:
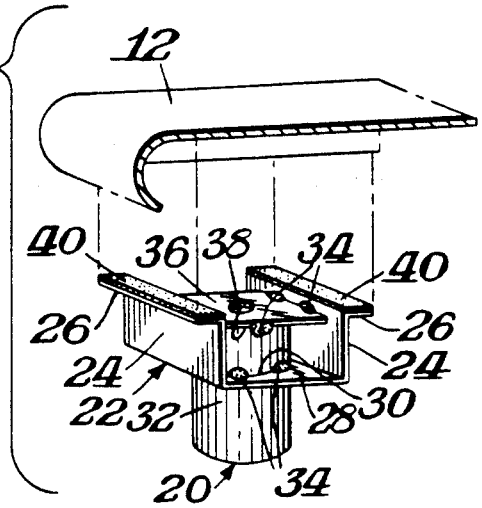
FIG. 2 is an exploded perspective view of the worktable top and one of the recessed leg supporting gussets of the present invention.
Figure 5:
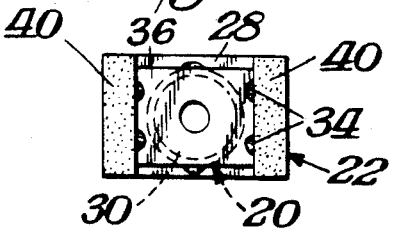
Figure 3:
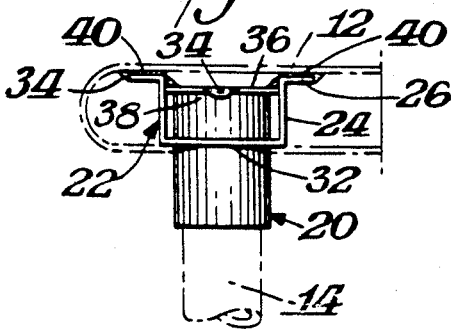
FIG. 3 is a front elevational view of the recessed leg supporting gusset, according to the present invention, with the worktable top shown in phantom outline.
Figure 4:
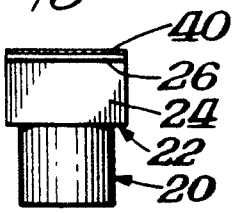
FIG. 4 is a side elevational view of the recessed leg supporting gusset shown in FIG. 3.

Referring in more particularly to the drawing, FIG. 1 shows a worktable 10 comprising a table top 12 and table legs 14. The particular worktable illustrated in FIG. 1 also includes a lower shelf 16 and display shelving 18 located above the table top and positioned at the back of the worktable.

The table legs 14 are secured to the underside of table top 12 by recessed leg supporting gussets 20 which in turn are fixedly secured to inverted hat-shaped channel frames 22 secured to the table top. The channel frames include opposite side portions 24 which extend downwardly and away from the underside of table top 12. Moreover, channel frames 22 include side flanges 26 which are fixedly secured to the underside of the tabletop by welding and the like. These side flanges extend outwardly from the side portions 24, as shown in the drawing. Finally, each inverted hat-shaped channel frame has a base portion 28 spaced away from table top 12 and parallel thereto. The base portion interconnects opposite side portions 24.

Each leg supporting gusset 20 is recessed into the inverted hat-shaped channel frames 22. Specifically, an opening 30 is provided in base portion 28 at each leg location, and the gusset 20 extends upwardly into the inverted hat-shaped channel frame through the opening. The middle section 32 of the leg supporting gusset 20 is secured by weld 34 to base portion 28 at the opening 30 therein.

Additionally, a back-up plate 36 is secured between the opposite side portions 24 of the channel frame 22. Welds 34 may be used to secure the back-up plate in place. An upper end 38 of the leg supporting gusset 20 is secured to the back-up plate 36 by welds 34.

The overall structural arrangement provides recessed leg supporting gussets which eliminate pivot points where the legs are connected to the worktable top. Increased stability and resistance to flexing are achieved with these gussets. The legs 14 are simply inserted into the open sockets provided by the recessed leg supporting gussets.

Preferably, the worktable is fabricated from metal. Moreover, sound dampening material 40 may be provided between the underside of the table top 12 and the upper surface of the side flanges 26.

What is claimed is:

1. A worktable comprising a table top and table legs, inverted hat-shaped channel frames secured to the underside of the table top, openings in the channel frames where the table legs are to be located, a leg supporting gusset at each leg location extending through the opening in the channel frame and upwardly recessed into the channel frame, means fixedly securing the gussets to the channel frames, each gusset having a socket for receiving one of the table legs, the channel frames including opposite side portions extending downwardly from the underside of the table top, side flanges secured to the table top extending outwardly from the side portions, and a base portion spaced away from the table top and parallel thereto interconnecting the opposite side portions, and openings for the leg gussets located in the base portions of the channel frames, the means securing the gussets to the channel frames including a back-up plate extending between the opposite side portions of each channel frame and secured thereto, each leg gusset including an upper end secured to the back-up plate, and each leg gusset including a middle section secured to the base portion of the channel frame at the opening therein.

2. A worktable as in claim 1 wherein the opposite side portions of each channel frame are planar and parallel to each other.

* * * * *